United States Patent [19]

Igel

[11] Patent Number: 4,630,435

[45] Date of Patent: Dec. 23, 1986

[54] SYSTEM FOR AUTOMATICALLY CHANGING SPOOLS OF A SPINNING MACHINE

[75] Inventor: Wolfgang Igel, Ebersbach, Fed. Rep. of Germany

[73] Assignee: Zinser Textilmaschinen GmbH, Ebersbach, Fed. Rep. of Germany

[21] Appl. No.: 749,870

[22] Filed: Jun. 27, 1985

Related U.S. Application Data

[63] Continuation-in-part of Ser. No. 595,992, Apr. 2, 1984, abandoned.

[30] Foreign Application Priority Data

Apr. 2, 1983 [DE] Fed. Rep. of Germany ..... 3312116

[51] Int. Cl.[4] ..... D01H 9/02; D01H 9/10; D01H 9/18

[52] U.S. Cl. ..... 57/281; 57/90; 57/266; 57/268; 57/270; 57/276; 242/35.5 R; 414/392

[58] Field of Search ..... 57/281, 270, 275–278, 57/90, 266–268; 198/409, 477.1; 414/392, 416; 242/35.5 R, 35.5 A

[56] References Cited

U.S. PATENT DOCUMENTS

| | | | |
|---|---|---|---|
| 1,384,449 | 7/1921 | Graf | 57/266 |
| 1,463,479 | 7/1923 | Miller | 57/266 |
| 2,952,113 | 9/1960 | Ingham | 57/268 |
| 3,264,027 | 8/1966 | Luther | 57/275 X |
| 3,307,340 | 3/1967 | Nishii et al. | 57/270 X |
| 3,370,411 | 2/1968 | Schulz et al. | 57/274 |
| 3,773,191 | 11/1973 | Ishida | 57/276 |
| 3,854,275 | 12/1974 | Bethea et al. | 57/276 X |
| 3,935,699 | 2/1976 | Iida | 57/270 X |
| 4,041,686 | 8/1977 | Inaba et al. | 57/281 |

FOREIGN PATENT DOCUMENTS

| | | |
|---|---|---|
| 2225673 | 11/1972 | Fed. Rep. of Germany . |
| 1760457 | 8/1973 | Fed. Rep. of Germany . |
| 1813110 | 7/1975 | Fed. Rep. of Germany . |
| 2021498 | 3/1976 | Fed. Rep. of Germany . |
| 550734 | 5/1974 | Switzerland . |
| 1624 | of 1902 | United Kingdom . |
| 712423 | 7/1954 | United Kingdom . |
| 854968 | 11/1960 | United Kingdom . |
| 1044477 | 9/1966 | United Kingdom . |
| 1190510 | 5/1970 | United Kingdom . |
| 1437294 | 5/1976 | United Kingdom . |

*Primary Examiner*—John Petrakes

*Attorney, Agent, or Firm*—Karl F. Ross; Herbert Dubno

[57] ABSTRACT

A spinning system has a spinning apparatus having a longitudinal succession of spinning stations, a creel extending longitudinally above the apparatus and having respective pendant hangers above the stations and each capable of holding a respective yarn package, and a respective slide above each station supporting the respective hanger slidable between an inner position directly above the respective station and an outer position above but horizontally offset therefrom. A reloading apparatus is displaceable longitudinally along the apparatus at least generally under the hangers in the outer positions of the respective slides. A magazine holds a supply of fresh roving packages on the reloading apparatus and a device is provided on the reloading apparatus for displacing the slide between the inner and outer positions. A grab on the reloading apparatus can grab the package on the hanger in the outer position of the respective slide. The displacing device includes a roller rotatable about a longitudinal axis, a drive for rotating the roller about the axis and an actuator for engaging the roller with the slide while rotating the roller about the axis to displace the slide between the positions.

8 Claims, 12 Drawing Figures

10
16
14
15
31
27
4
8
6
7
6
13
12
28
28
I
17
S
24
23
2
9
22
STRETCHER
5
5
28
3
1
29
SPINNER
5
35
26
25
M
26
11

SYSTEM FOR AUTOMATICALLY CHANGING SPOOLS OF A SPINNING MACHINE

CROSS REFERENCE TO RELATED APPLICATION

This application is a continuation-in-part of copending patent application Ser. No. 595,992 filed Apr. 2, 1984 (now abandoned).

FIELD OF THE INVENTION

The present invention relates to a spinning machine. More particularly this invention concerns a spinning apparatus and system for automatically reloading it with fresh spools or packages of roving or yarn.

BACKGROUND OF THE INVENTION

A spinning machine normally, has a longitudinally extending row of spinning stations each having a drawing frame or stretcher and a spinner, the latter normally of the ring type. A creel is provided above this machine for holding spools of yarn or roving, typically two spools for each station.

Since such machines operate at high speed, the yarn supplies are used up fairly rapidly, making it a full-time job for someone to refill the empty stations. A sensor is provided at each station to signal when it has run out of yarn or roving, and a brake is provided so that the end of the previous filament is not pulled through the spinner. Thus the operator reloads the empty spool holder and attaches the start of its filament to the end of the preceding one and restarts the station.

It is common to spin together two filaments, and in this case the machines are often loaded with two identical bobbins or spools at the same time. Since the filaments are of the same length, they will run out at the same time, necessitating replacement of both packages. In such a machine the one package is normally behind the other, so that the operator must reach around one holder to get at the other.

Although it has been suggested to automate the reloading of the yarn holders, no system has yet been proposed that was capable of doing so without requiring large-scale redesign of the spinning machine and that could replace the outside and inside packages inside a compact creel.

OBJECTS OF THE INVENTION

It is therefore an object of the present invention to provide an improved spinning apparatus.

Another object is the provision of such a spinning apparatus which overcomes the above-given disadvantages, that is which reloads automatically and that is relatively simple and compact.

SUMMARY OF THE INVENTION

A spinning system according to the invention has a spinning apparatus having a longitudinal succession of spinning stations, a creel extending longitudinally above the apparatus and having respective pendant hangers above the stations and each capable of holding a respective yarn package, and a respective slide above each station supporting the respective hanger slidable between an inner position directly above the respective station and an outer position above but horizontally offset therefrom. A reloading apparatus is displaceable longitudinally along the apparatus at least generally under the hangers in the outer positions of the respective slides. A magazine holds a supply of fresh roving packages on the reloading apparatus and a device is provided on the reloading apparatus for displacing the slide between the inner and outer positions. A grab on the reloading apparatus can grab the package on the hanger in the outer position of the respective slide.

Thus with the system of this invention the yarn-package hangers can be pulled out so an automatic apparatus can remove the empty spool cores from the hangers and mount full packages thereon. Not having to reach inside the machine makes it possible to design the automatic reloading apparatus to be relatively simple.

According to another feature of this invention the displacing means includes a roller rotatable about a longitudinal axis, a drive for rotating the roller about the axis, and an actuator for engaging the roller with the slide while rotating the roller about the axis to displace the slide between the positions. More particularly, a two-arm lever pivoted on the reloading apparatus about a longitudinal axis has one arm carrying the roller and another arm connected to the actuating means. The lever is pivotal between a position with the roller engaging vertically against the slide and a position with the roller out of engagement with the slide. Such a mechanism works very effectively, and can even be used to arrest the slide when in the outer position, simply by holding the roller against it while not rotating the roller. To this end the roller is carried directly on its drive motor which cannot be reverse driven.

In accordance with a further feature of this invention the grab is closable on a spool in the magazine and on a spool on the hanger in the outer position above the reloading apparatus. This grab can be displaced horizontally and vertically between the magazine and the hanger. More particularly the grab can be pivotal horizontally between these positions, and the slide has two hangers that equidistantly flank the upright pivot axis of the grab in the outer slide position. Furthermore, the reloading apparatus is provided with a bin for receiving empty package cores, normally bobbin tubes. To this end this bin is provided under the arcuate path of the grab.

DESCRIPTION OF THE DRAWING

The above and other features and advantages will become more readily apparent from the following, reference being made to the accompanying drawing in which.

SPECIFIC DESCRIPTION

Figure 1:
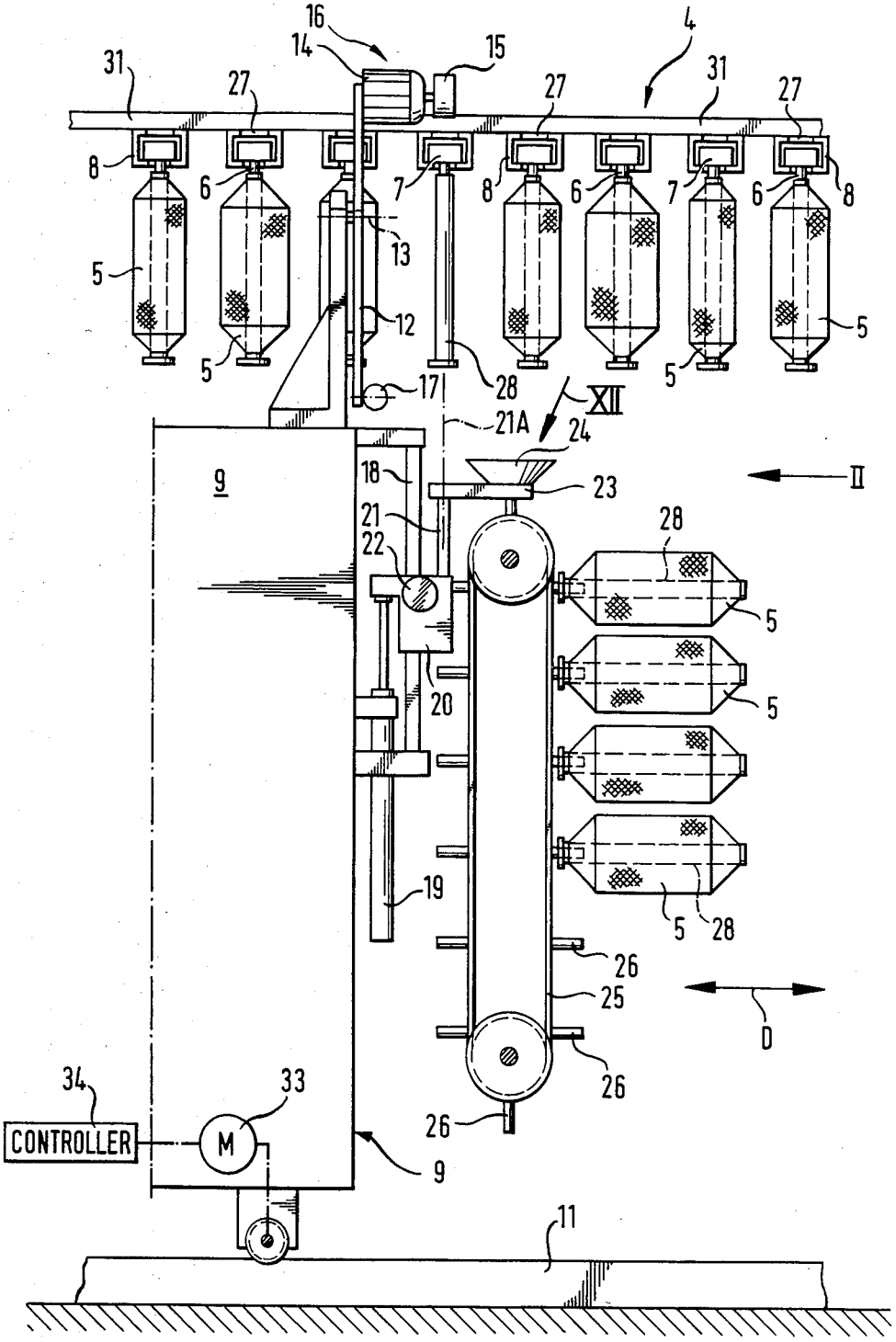
FIGS. 1 and 2 respectively are side and end views of the system of this invention in a first stage of operation.

As seen in FIGS. 1, 2, 9, and 10, a system according to this invention has, a multiple ring-spinning machine 1 provided with a drawing frame or stretcher 2 and a spinner 3. An overhead creel 4 is provided that supports pairs of yarn or roving packages 5, two above each stretcher-spinner unit 2, 3 and each having a tubular core 28. As is known, the roving is pulled off these packages 5, and then passes sequentially through the stretcher 2 and spinner 3.

Figure 10:
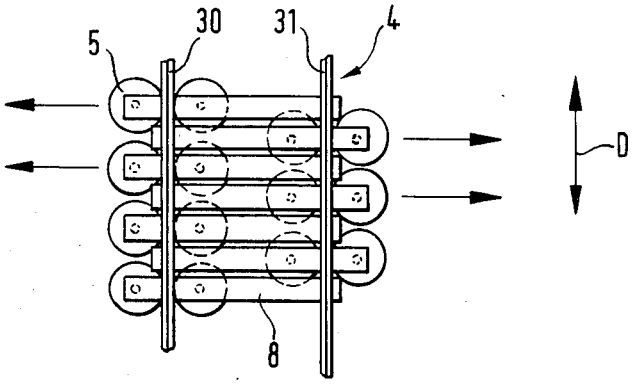
FIG. 10 is a small-scale top view of a portion of the spool creel of this invention.
Figure 11:
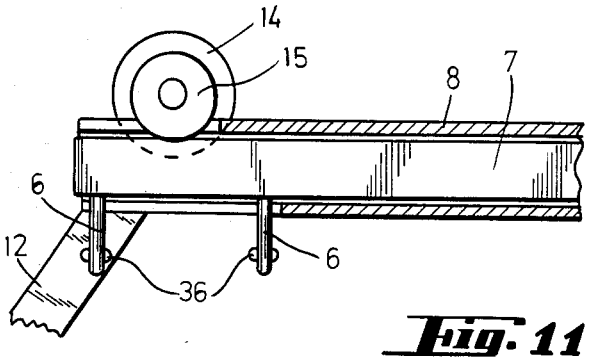
FIG. 11 is a vertical large-scale section taken along line XI—XI of FIG. 3.

The machine 1 extends longitudinally in a horizontal direction D and has overhead beams 30 and 31 (FIG. 10) under which guides 8 of the creel 4 are secured. These guides 8 extend horizontally perpendicular to the direction D and each hold a rail 7 slidable horizontally perpendicular to the direction D. Two hangers 6 for the packages 5 depend from each of the rails 7, adjacent one end thereof. As seen in FIG. 10 the rails 7 are very close together and carry the packages 5 at alternate ends for maximum storage density and efficient use of plant space. FIG. 11 shows how each hanger.6 is formed as a pin with a pair of radially outwardly spring-biased balls 36 that can press with sufficient force against the inside of the tubular core 28 of the respective package 5 that same does not fall and that in fact the yarn can be pulled from it without pulling the entire package 5 off its hanger 6.

An automatic spool- or package-changing machine 9 can move in the direction D along ceiling and floor rails 10 and 11 past the creel 4. It carries a sliding device 16 for moving one of the rails 7 transversely of the direction D. This device 16 has a two-arm lever 12 pivotal by a pneumatic actuator 17 about an axis 13 parallel to the direction D and having an upper end carrying a motor 14 whose output shaft carries a roller 15 engageable through a cutout 27 (FIG. 9) in the end of the guide 8 with the rail 7 when, as described below, this roller 15 has been vertically aligned above the top end of the rail 7 to be moved. The roller 15 is rubber covered so that, when it is engaged with one of the rails 7 and rotated about its axis which extends in the direction D, it moves this rail 7 in a direction dependent on its rotational sense. The rails 7 can move in the respective guides 8 between stable end positions, and the roller 15 is typically rotated sufficiently while contacting one of the rails 7 that it moves same fully from the one into the opposite end position, even allowing for some slip.

A drive motor 33 operated by a computer-type controller 34 moves this apparatus 9 to position it at each station defined by one of the rails 7, there obviously being one such apparatus to each side of the system is apparent from FIG. 10. The actuator 17 can tip the lever 12 to engage the roller 15 through the cutout 27 in the top of the guide 8 to press directly against the top surface of the respective rail 7, thereby displacing same as described above in a direction dependent on the rotation sense of the roller 15.

Figure 12:
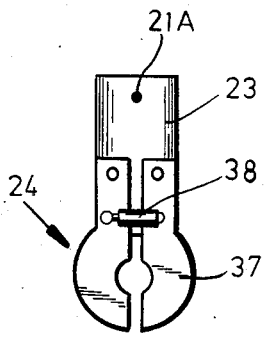
FIG. 12 is a large-scale top view of the detail indicated at XII in FIG. 1.

In addition the apparatus 9 carries on its front end a vertical rail 18 on which a slide or carriage 20 can be vertically displaced by an actuator 19 operated by the controller 34. This slider or carriage 20 in turn carries a vertical post 21 that carries a horizontally extending arm 23 that can be pivoted through 180° about the vertical axis 21A by another actuator 22 (FIG. 9) operated by the controller 34. The outer end of this arm 23 is constituted as a grab 24 for the spools 5. The grab 24 can also be operated by the controller 34 to grip and release the spools 5. As seen in FIG. 12, the grab 24 has a pair of jaws 37 that can be moved together and apart by a small actuator 38 so as to grip around the lower end of the core 28 of one of the packages 5.

The front end of the apparatus 9 also carries a conveyor belt 25 carrying fourteen equispaced supports 26 that are shaped to fit into the bottom ends of full spools 5 that are used to replace empty cores 28 as will be described below. These supports 26 are identical to the friction-type hangers 6. This belt 25 is driven by a motor 35 and can move the supports 26 sequentially through an upper takeoff station S in which the uppermost support 26 and its spool 5 is vertical and can be picked off by the grab 24. The supports 26, like the hangers 6, each fit snugly in the end of the tubular core 28 of the respective spool 5 with sufficient force to prevent it from falling off if it is turned upside down. This friction fit between the cores 28 and packages 5 is not so tight that it prevents the grab 24, when its jaws 37 grip a core 28 in the upper takeoff station S and its actuator 19 is extended to lift it, from pulling a package 5 up off the support 26 in the station S.

Figure 4:
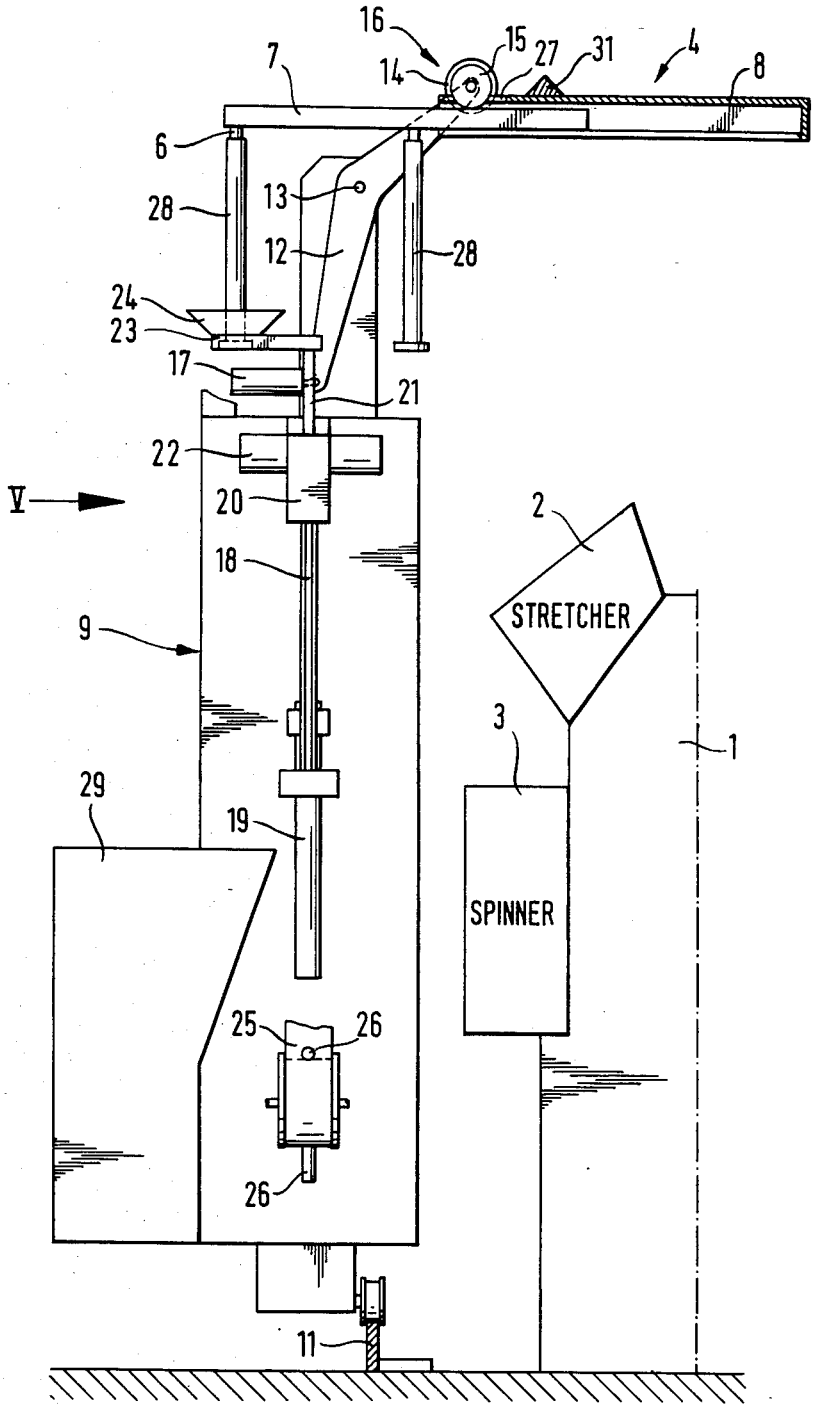

On its outer side turned away from the spinner 1 the apparatus 9 carries a bin 29 (FIGS. 2, 4, and 6) in a location underneath the arcuate 180° path of the grab 24, so that empty cores 28 can be dropped into it as will be described below.

The apparatus described above functions as follows:

As is known, automatic devices or sensors connected to the controller 34 normally detect when one of the spools 5 is about to run out, and shut off the respective stretcher 2 and spinner 3 before this happens so that there is a tail or end left. A simple feeler for detecting spool diameter can most easily accomplish this. Since both packages 5 for one spinner 3 are normally mounted on the rail 7 at the same time and both have the same amount of yarn, it is normal for them to run out at the same time.

Figure 2:
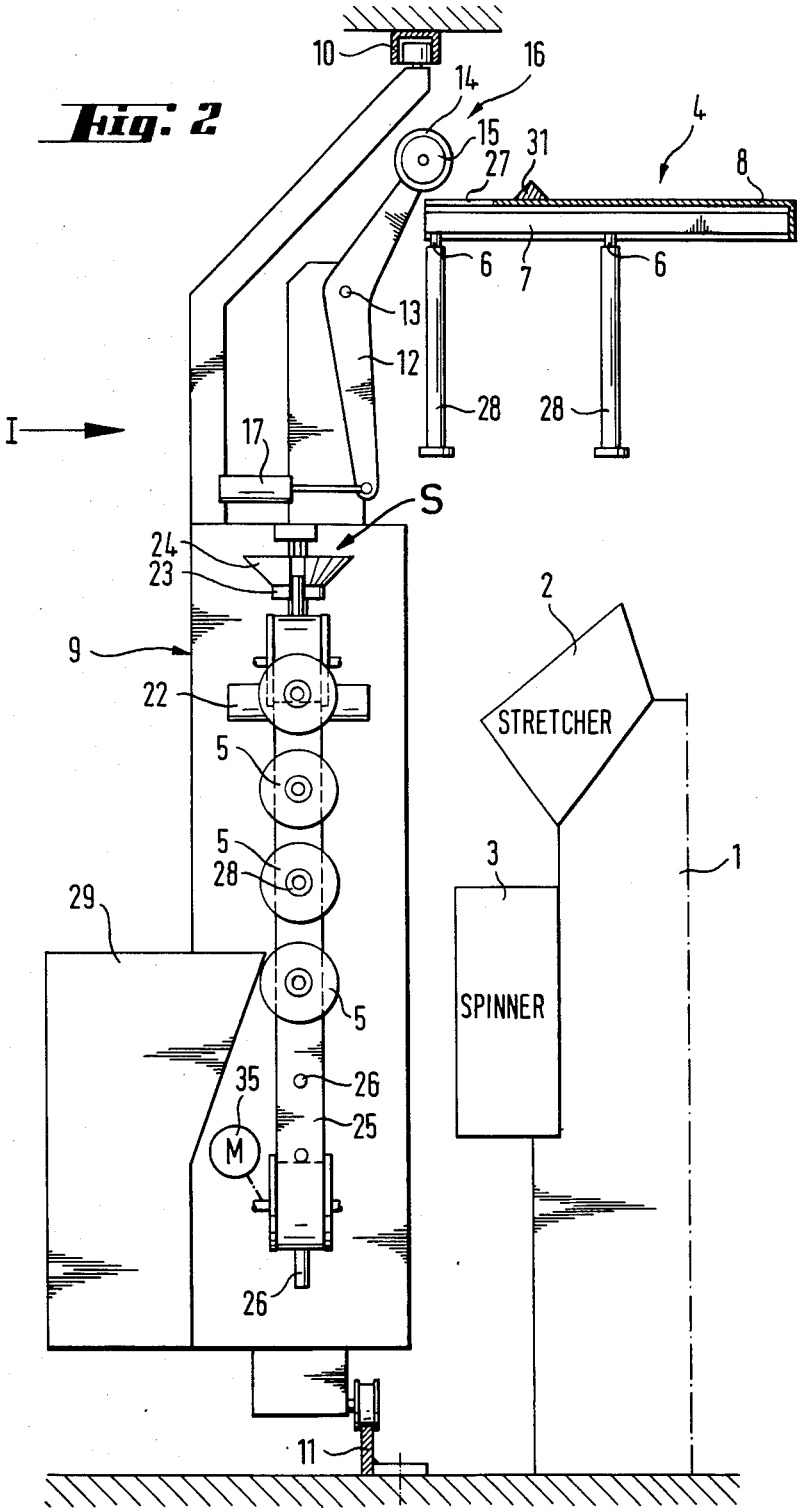

When the packages 5 of one spinning station have run out, leaving empty spindles 28 on the respective rail 7, the controller 34 moves the apparatus 9 along its tracks 10 and 11 into a position shown in FIGS. 1 and 2 where the vertical pivot axis 21A defined by the guide rod 21 is aligned horizontally in a vertical plane P (FIG. 9) perpendicular to the direction D with the empty rail 7. In this position the arm 23 extends in the direction D from the axis 21A, and no spools 5 are in the takeoff station S at the upper end of the conveyor 25 where the grab 24 can take them off.

Figure 3:
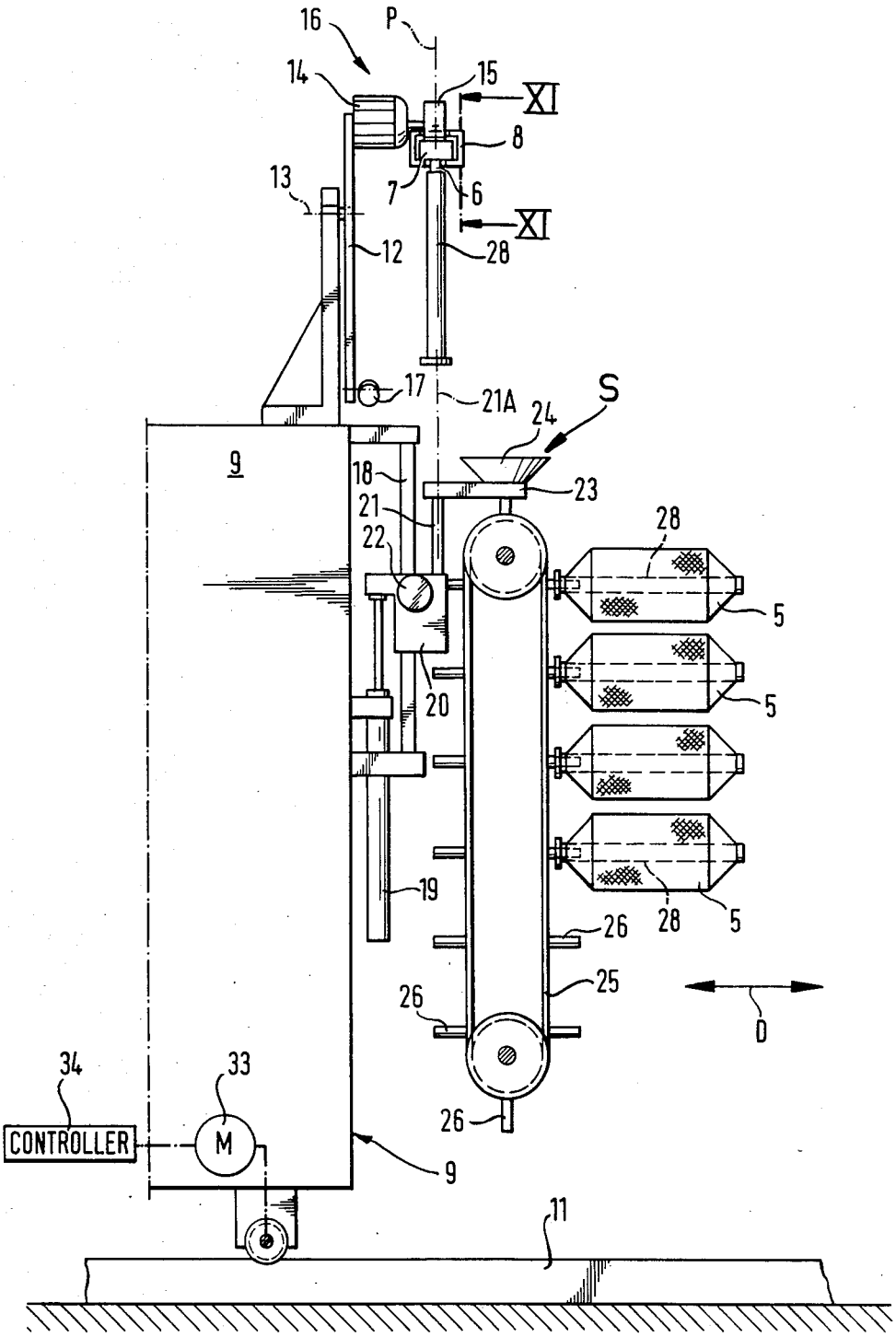
FIGS. 3 and 4 are a side view and a partly sectional end view showing the system of this invention in two further stages of operation.
Figure 9:
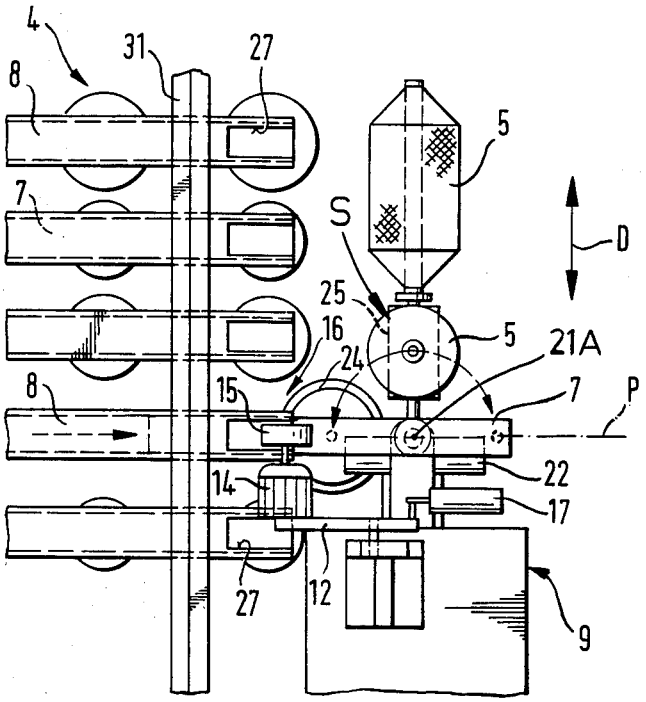
FIG. 9 is a top view of a detail of the system as indicated by arrow IX in FIG. 8.

Then as shown in FIG. 3 the actuator 17 shortens to pivot the two-arm lever 12 and press the roller 15 down through the cutout 27 onto the top of the rail 7 carrying the empty cores 28. The motor 14 then rotates the roller 15 to slide out the rail 7 until as shown in FIGS. 3 and 9 the two hangers 6, still in the plane P, equidistantly flank the axis 21A.

Figure 5:
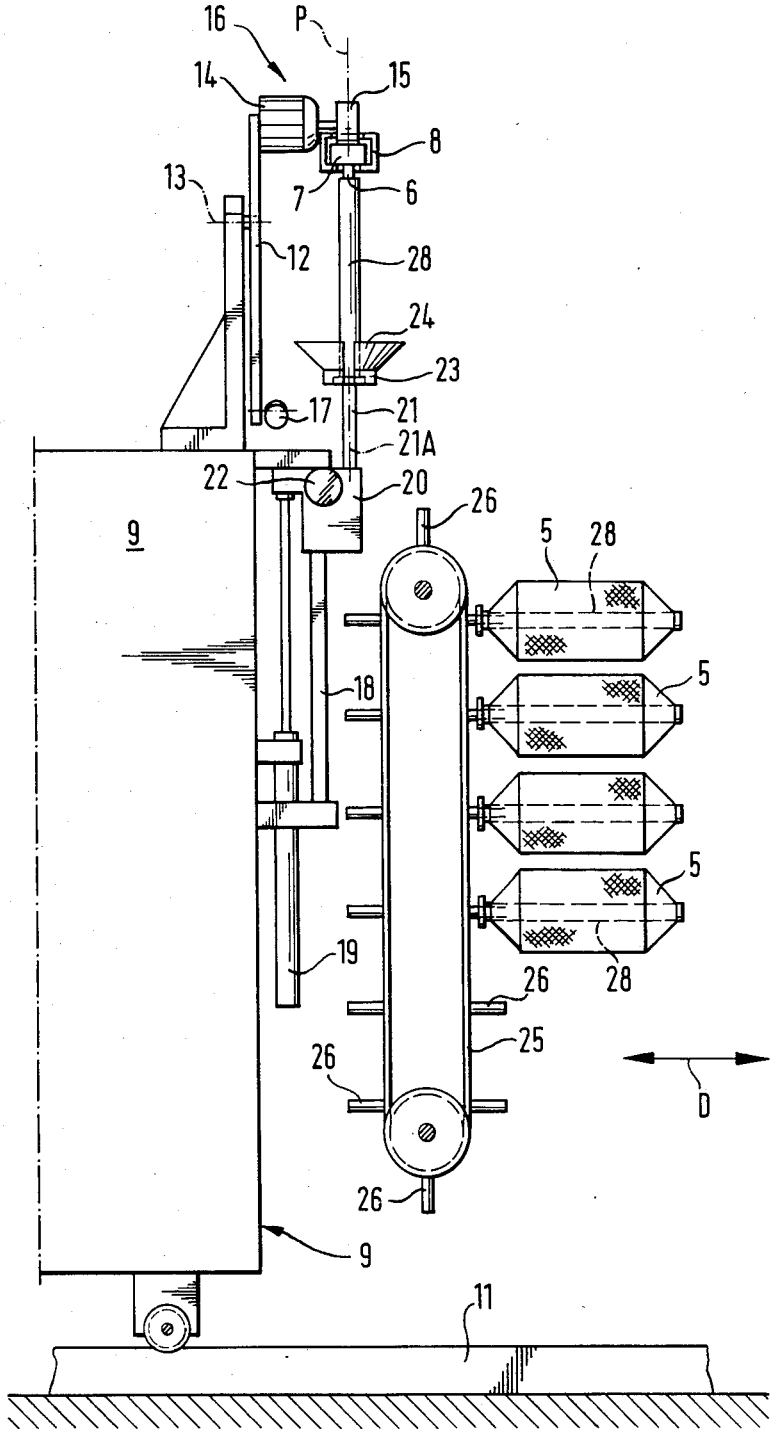
FIG. 5 is a side view corresponding to the position of FIG. 4.

The actuators 19 and 22 then raise and pivot the grab 24 through 90° to align it underneath one of the empty spindles 28, whereupon it is raised (FIG. 5) and the actuator 38 closes the jaws 27 on the empty spindle 28. The actuator 19 then shortens to drop the grab 24 and simultaneously pull the gripped empty spindle 28 off the respective hanger 6.

Figure 6:
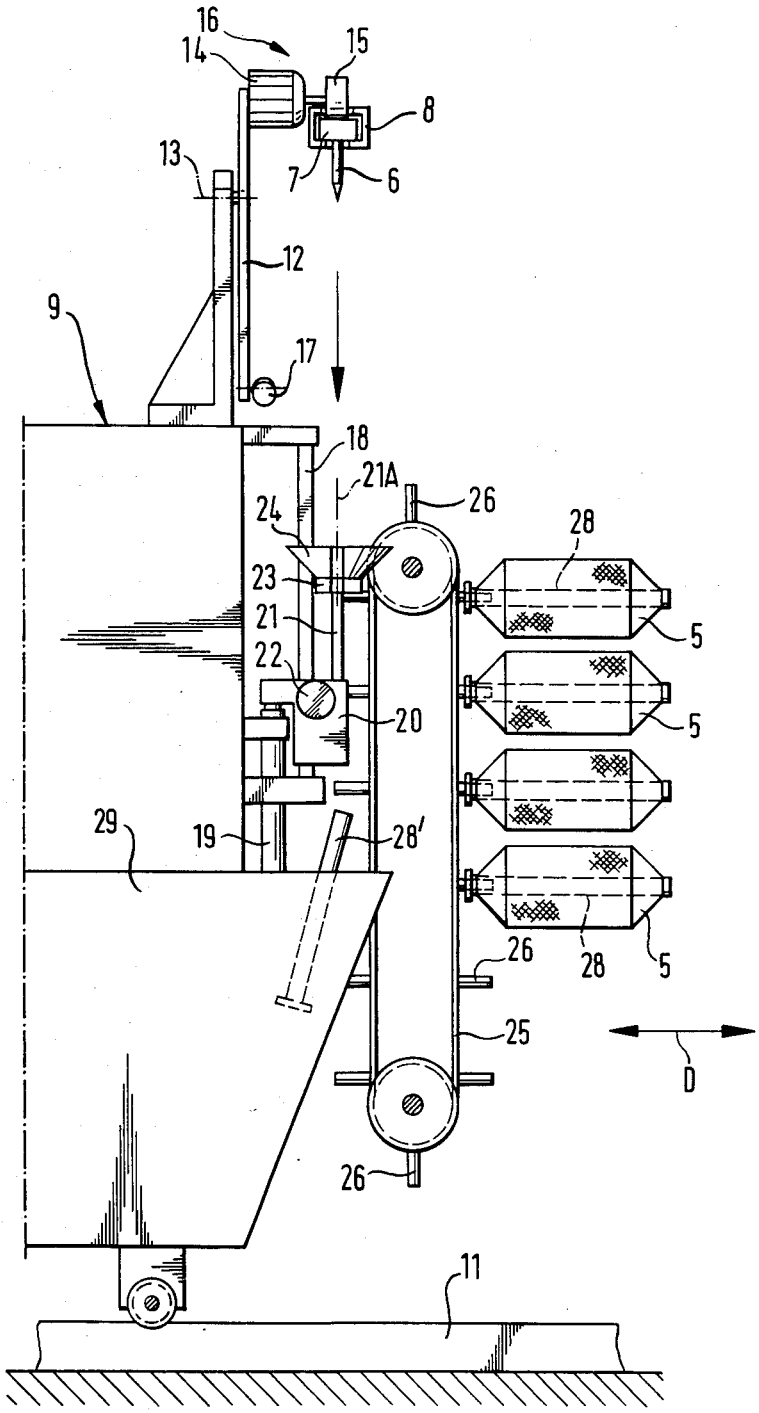
FIGS. 6, 7, and 8 are side views showing the system in three further stages of operation.

The actuator 22 subsequently pivots the grab 24 if necessary into position over the bin 29 so the jaws 37 can be opened and the spindle 28 can be dropped thereinto, and the sequence is repeated to remove, grab, and then dispose of the other empty spool 28 as shown in FIG. 6, leaving both hangers 6 empty and leaving the rail 7 held in place by the nonrotating roller 15.

Figure 7:
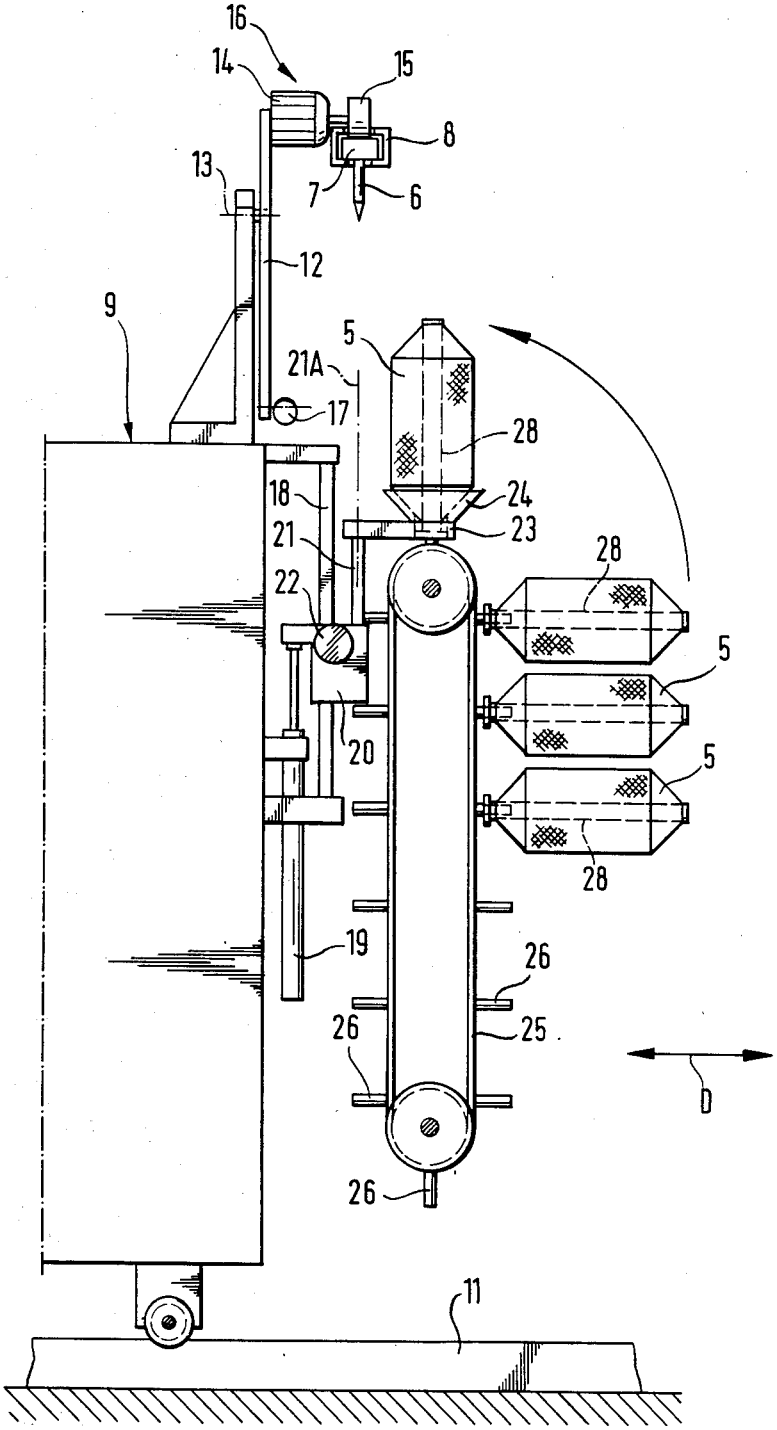
Figure 8:
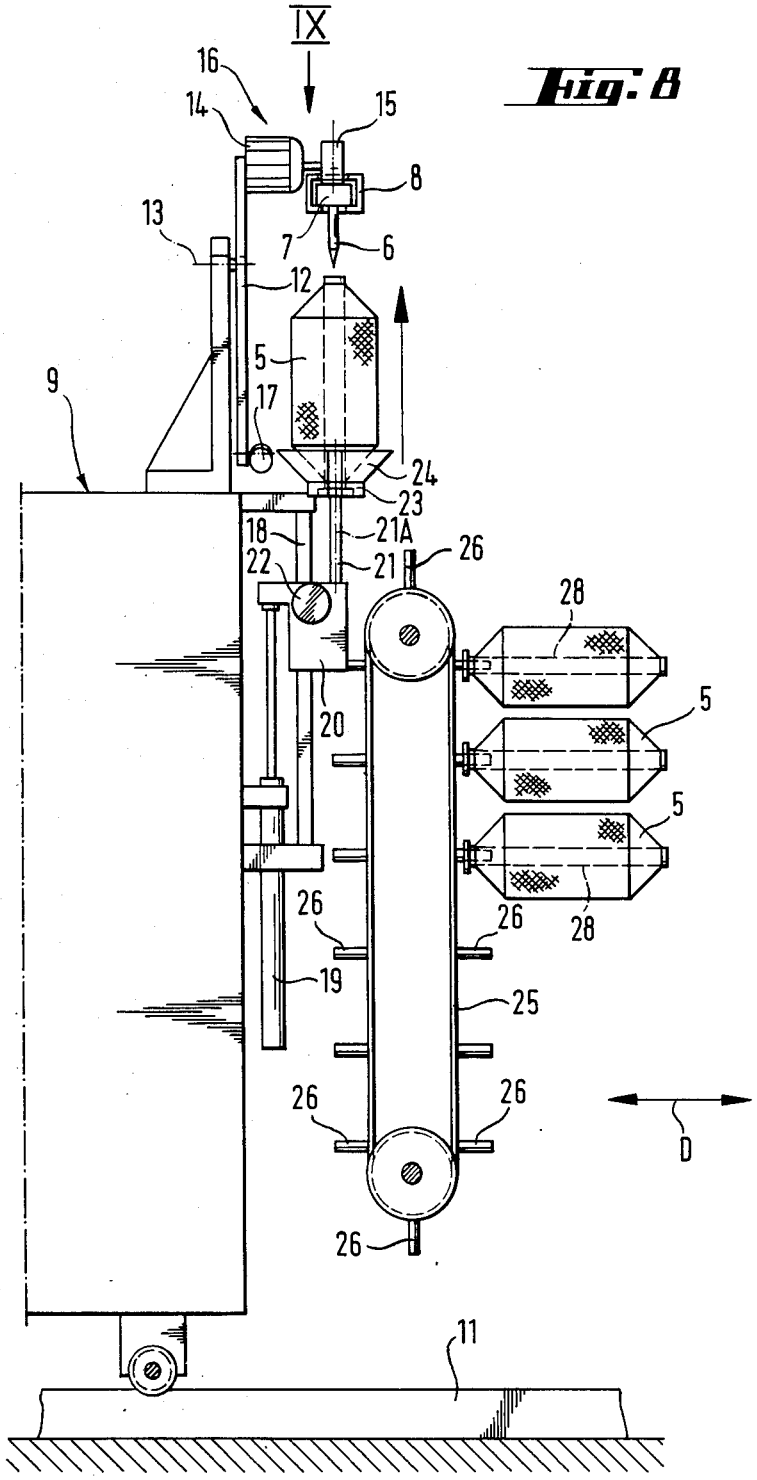

The grab 24 is moved back into its position down and in the station S, and the controller 34 moves the conveyor 25 by means of the drive motor 35 to bring one of the full spools 5 into the top takeoff position as shown in FIG. 7. The empty pin support 26 in the station S passes between the jaws 37 and the loaded pin following it moves into position between these jaws 37. The actuators 19 then lifts the grab 24 to pick off the full package 5 and the actuator 22 pivots the grab 24 with the full spool 5 it carries as shown in FIGS. 8 and 9 into a position aligned underneath one of the empty hangers 6. The actuator 19 then pushes the spool 5 up onto the hanger 6, where it is retained as described above by the balls 36.

These last steps of FIGS. 6 through 9 are then repeated with another spool 5 and the other spindle 28, reloading the other hanger 6. Then the steps of FIG. 3 and FIG. 2 are carried out, but with opposite rotation of the roller 15 to return the rail 7 to the starting position. The yarns or rovings are then spliced together by the machine operator and the respective stretcher 2 and spinner 3 are restarted.

The operation of this system is quite straightforward, allowing a relatively simple piece of automatic machinery to change both spent bobbins 28 in one operation, or allowing only one to be changed if that is necessary. The apparatus takes up a modest amount of space next to the ring-spinning machine due to the use of the slide-out rails 7 according to this invention. One person who need merely tend to splicing in the new yarn ends can therefore tend a large battery of machines and is spared the labor of lugging and handling the yarn packages.

I claim:

1. A spinning system comprising:

a spinning apparatus having a longitudinal succession of spinning stations;

a creel extending longitudinally above the apparatus and having respective pendant hangers above the stations and each capable of holding a respective yarn package;

a respective slide above each station supporting the respective hanger slidable between an inner position directly above the respective station and an outer position above but horizontally offset therefrom;

a reloading apparatus displaceable longitudinally along the apparatus at least generally under the hangers in the outer positions of the respective slides;

a magazine holding a supply of fresh roving packages on the reloading apparatus;

means on the reloading apparatus for displacing the slide between the inner and outer positions; and means on the reloading apparatus for grabbing the package on the hanger in the outer position of the slide.

2. The spinning system defined in claim 1 wherein the displacing means includes:

a roller rotatable about a longitudinal axis transverse to the displacement direction of the slide when moving between its inner and outer positions;

means for rotating the roller about the axis; and actuating means for engaging the roller with the slide while rotating the roller about the axis to displace the slide between the positions.

3. The spinning system defined in claim 2 wherein the displacing means includes a two-arm lever pivoted on the reloading apparatus about a longitudinal axis and having one arm carrying the roller and another arm connected to the actuating means, the lever being pivotal between a position with the roller engaging vertically against the slide and a position with the roller out of engagement with the slide.

4. The spinning system defined in claim 2 wherein the grabbing means includes:

a grab closable on a spool in the magazine and on a spool on the hanger in the outer position above the reloading apparatus;

means for displacing the grab horizontally between the magazine and the hanger; and means for displacing the grab vertically between the magazine and the hanger.

5. The spinning system defined in claim 4 wherein the grab can engage and remove empty package cores on the hangers and pick up and mount full packages on the hangers.

6. The spinning system defined in claim 1 wherein each such slide carries two such hangers.

7. The spinning system defined in claim 6 wherein the grabbing means includes:

a grab closable on a spool in the magazine and on a spool on the hanger of the hanger in the outer position above the reloading apparatus;

means for pivoting the grab horizontally about an upright axis along an arcuate path between the magazine and the hanger, the hangers of a slide equidistantly flanking the upright axis in the outer hanger position; and means for displacing the grab vertically between the magazine and the hanger.

8. The spinning system defined in claim 7, further comprising:

a bin for empty package cores on the reloading apparatus and under the path of the grab.

* * * * *